US005738458A

United States Patent [19]

Ulrich

[11] Patent Number: 5,738,458

[45] Date of Patent: Apr. 14, 1998

[54] LIQUID-DEPOSITING IMPLEMENT FOR WRITING, DRAWING, PAINTING, FOR COSMETICS AND THE LIKE

[75] Inventor: Günter Ulrich, Hanover, Germany

[73] Assignee: Pelikan GmbH, Hanover, Germany

[21] Appl. No.: 638,735

[22] Filed: Apr. 29, 1996

[30] Foreign Application Priority Data

May 23, 1995 [DE] Germany ..... 195 18 814.4

[51] Int. Cl.[6] ..... B43K 8/02

[52] U.S. Cl. ..... 401/151; 401/230

[58] Field of Search ..... 401/151, 230, 401/133

[56] References Cited

FOREIGN PATENT DOCUMENTS

| | | |
|---|---|---|
| 2 594 721 | 2/1987 | France . |
| 3733774 A1 | 4/1988 | Germany . |
| 596262 | 12/1947 | United Kingdom . |

*Primary Examiner*—Jerome Donnelly

*Attorney, Agent, or Firm*—Nikaido, Marmelstein, Murray & Oram LLP

[57] ABSTRACT

A liquid-depositing implement includes a tubular case (1) containing a supply chamber (2) and a reservoir (3) isolated from the chamber with both the chamber and reservoir being fillable with a deposition liquid. A depositing element (6) can be mounted to the case (1) and connected to the supply chamber (2). The supply chamber includes a valve-system (4) composed of two mutually telescoping and displaceable bushes (9, 10) resting tightly against each other and enclosing a cell (16) bounded at each of its axial ends by at least one base (14, 15) affixed to the inner or outer bush. Two sets of cooperating valve apertures (17, 18; 19, 20) are present in such manner in the walls of the bushes (9, 10) that by rotating one bush (10) relative to the other bush (9), first one set of valve apertures (19, 20) passes from a communicating position to a sealed position and thereupon the other set of valve apertures (17, 18) passes from the sealed position into the communicating position.

20 Claims, 3 Drawing Sheets

LIQUID-DEPOSITING IMPLEMENT FOR WRITING, DRAWING, PAINTING, FOR COSMETICS AND THE LIKE

BACKGROUND OF THE INVENTION

The present invention concerns a liquid-depositing implement for writing, painting, for applying cosmetics or like purposes, comprising a tubular case, hereafter called "case", containing a supply chamber and a reserve space separate from the chamber, both chamber and reserve space receiving a writing or deposition liquid, a deposition element affixed to the case and connected to the supply chamber, with the supply chamber comprising a cell with a valve-system interrupting the communication between the cell and the supply chamber when this cell is made to communicate with the deposition element and interrupting the communication between the cell and the deposition element when this cell is made to communicate with the reserve space.

A liquid-depositing implement disclosed in the German patent document A1 37 33 774 includes a valve with a valve pushrod passing through the cell and bearing a writing tip at its front end. A valve body is affixed to the valve pushrod and passes through the cell wall. A writing tip is provided at its front end. Normally the valve body is pressed by a valve spring against a valve seat. The valve body also acts as a piston which is displaceable in liquid-tight manner in a cylinder mounted inside the cell. The rear end of the valve pushrod cooperates with an aperture in the rear wall of the cell. It comprises four grooves with a length selected so that, when the piston dips into the cylinder, the grooves will partly enter the aperture and the cell will communicate through the grooves with the inkwell. The ink is supplied to the writing tip only when pressure is applied to the tip. In this procedure the valve pushrod must be pressed against the force of the valve spring so far into the cell that the valve-body piston leaves the cylinder, as a result of which the cell will communicate with the writing tip. When the pressure is taken off the writing tip, then the piston will additionally feed the writing liquid present in the cylinder through the valve seat to the writing tip before the valve body shall seal the valve seat. The known implement is designed preferentially for deposition liquids of substantial viscosity which would arrive only in inadequate manner at the writing tip in the absence of such an additional conveyor means. As a rule the deposition of the liquid is in thick lines, so that adequate writing pressure is available to drive the valve. However, this known implement is unsuited for finer writing or drawing. Moreover, the known implement incurs a special drawback in that excessive liquid is conveyed by the piston to the writing tip on account of frequent deposition and lifting of the deposition implement.

OBJECT AND SUMMARY OF THE INVENTION

The object of the present invention is to create a liquid-depositing implement which shall be suitable for low-viscosity writing or deposition liquids, shall be manufacturable in economical manner and easily handled, and wherein the deposition element may be rigidly affixed to the case.

The invention solves this problem in that the valve-system consists of two mutually telescoping and displaceable tightly adjoining bushes enclosing a cavity forming the cell, the cavity being bounded at each of its axial ends by at least one of the bases mounted to the inner or outer bush and in that two sets of cooperating valve apertures are present in the bush's walls or bases in such a way that when rotating or axially displacing one bush relative to the other, the one set of valve apertures shall be moved from a communicating position wherein the valve apertures of both bushes are overlapping or intersecting into a closed position wherein the wall of one bush closes the valve apertures of the other bush, and thereafter the other set of valve apertures moves from the closed position to the communicating position.

The invention creates a liquid-depositing implement wherein the supply of writing or deposition liquid to the deposition tip is independent of the nature of the writing. As a result the deposition tip may be designed in arbitrary manner and for instance may also be in the form of a soft wick or a writing pen. During writing or deposition, the valve-system is moved, by drive means located on the case, into a position wherein the cell continuously communicates with the deposition tip. This valve-system position may be maintained until all the liquid in the supply chamber including the cell has been used up. The supply chamber and the cell are sized in such manner that, by a flow control mounted on the deposition element, uniform liquid supply to the deposition tip is assured and that air-pressure or temperature fluctuations do not cause excessive liquid feed to the deposition tip. The valve-system of the invention furthermore offers the advantage that switching the valve-system to refill the cell from the reserve space and the resetting into the writing position can be carried out without changing the volume of the cell and of the supply chamber and reserve space, and accordingly uniform liquid feed to the deposition tip will not be degraded by switching the valve-system. The valve-system moreover is also suitable to control liquid discharge when the cell volume constitutes the predominant portion of the supply chamber and when the non-operating cell is isolated from the supply chamber by correspondingly setting the valve-system. Another advantage of the valve-system of the invention is simple design, whence it may be manufactured very economically. Again the two valve-system bushes are integrated in an especially simple manner into the case of a writing implement and the valve-system can be operated by simple means. Illustratively the invention provides that the case comprise two mutually rotatable or axially displaceable segments, one of which being connected to one bush and the other to the other bush by means transmitting rotation or longitudinal translation. Another possible simplification is that one of the valve-system bushes is constituted by a case segment.

In another frequently advantageous embodiment variation of the deposition implement of the invention, wherein the case is composed of a rear and of a front segment linked together in a rotatable or longitudinally displaceable manner, the rear segment containing the reserve space and the front segment the supply chamber and deposition element, both segments are each rigidly joined to one valve-system bush. This embodiment variation offers simple handling because case segments are easily gripped. Furthermore it offers the advantage of the reserve space being free of integrated elements and as a result being able to receive exchangeable, large writing-liquid cartridges. In this respect the cartridge forming the reserve space is appropriately fitted with a cylindrical connection adapter in the form of a segment of the outer valve-system bush and containing valve apertures by which the cartridge can communicate with the cell. The case and the cartridge are fitted with mutually matching stops allowing to affix the cartridge in the rear case segment in a specified installed position.

In another embodiment variation of the liquid-depositing implement of the invention, the rear case segment containing the reserve space is detachably connected with the front case segment and assumes the form of an exchangeable cartridge. Advantageously in such a design the inner bush connected to the front case segment shall be sealed at both ends by a base and the outer bush open at both ends shall be integrated into the rear case segment. The bore of the outer bush in this case is appropriate to receive a seal to seal, during transport, the rear segment filled with the writing liquid. When the rear case segment is linked to the front case segment, the seal will be forced by the inner bush out of the bore of the outer bush.

In a further design of the invention, the liquid-depositing implement comprises an inner bush which is rigidly joined at one end to a front case segment and at the other end to a rear case segment, and the outer bush has an externally accessible gripping surface running between the two case segments, with the gripping surface being used to rotate the external bush or to displace it axially. Again this design allows equipping in simple manner the reserve space with an exchangeable cartridge or to make the rear case segment into an exchangeable cartridge.

Basically the liquid-depositing implement of the invention also may be designed in such manner that it can be refilled with deposition liquid from a replenishing vessel. Appropriately then, the reserve space shall comprise a sealable replenishing aperture accessible only from the outside when the cell is sealed off the supply chamber but communicating with the reserve space. In this way the reserve space and the supply-chamber cell can be filled while at the same time deposition liquid is prevented from reaching the deposition tip and from issuing there during the replenishing procedure. Furthermore the valve apertures connecting the cell to the deposition element in the valve-system of the invention may be designed as a control segment to control the flow to the deposition element. Moreover the flow cross-section of the control path may be made adjustable using markings to allow matching the control procedure to different writing or deposition liquids. In the invention, the switch positions of the valve-system may be set by stops and/or by markings on the case.

The valve-system of the invention also allows a switch position for the valve apertures wherein all valve apertures are closed. That position offers high protection against the writing or deposition liquid leaving the reservoir.

BRIEF DESCRIPTION OF THE DRAWINGS

The invention is elucidated below in relation to illustrative embodiments shown in the drawing.

DETAILED DESCRIPTION OF PREFERRED EMBODIMENTS

Figure 1:
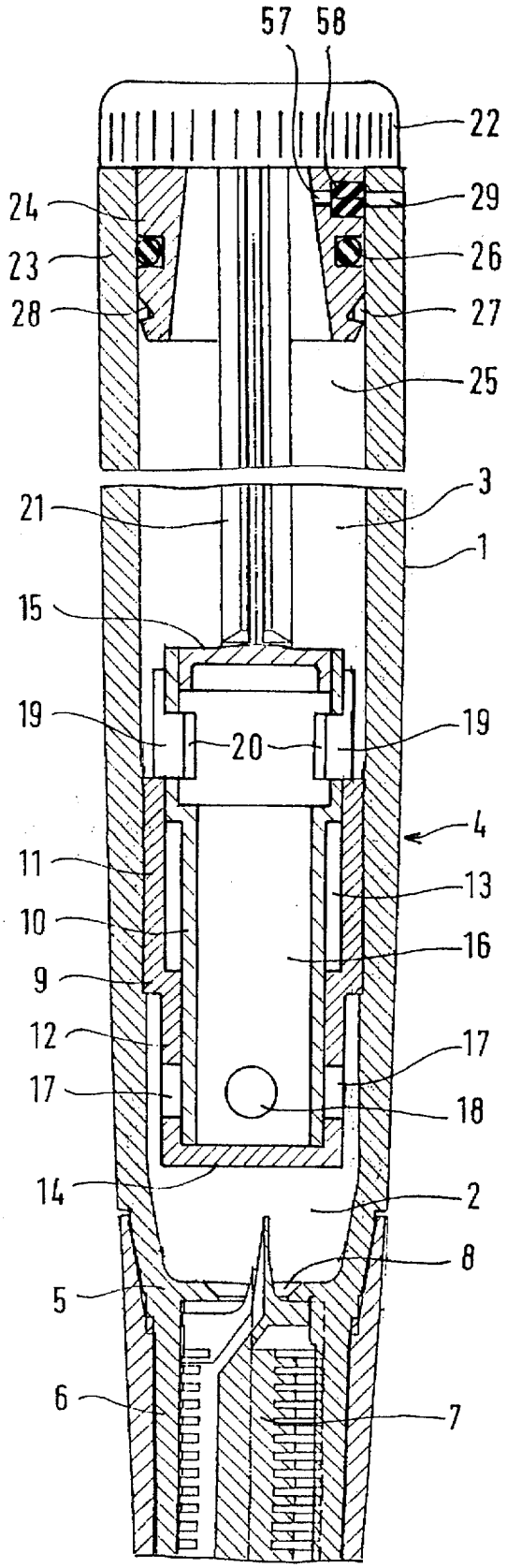
FIG. 1 is a longitudinal section of a fountain pen with an integral case and rotary knob to drive the valve-system.

The fountain pen shown in FIG. 1 comprises a case 1 containing a supply chamber 2 and a reservoir 3 isolated from each other by a valve-system 4. A writing tip 6 which is only partly shown is affixed to the front end 5 of the case 1 adjoining the supply chamber 2 and contains an ink controller 7 with capillaries and balancing spaces. The ink controller 7 communicates through an aperture 8 with the supply chamber 2 which it connects to a deposition element, for instance a writing pen.

The valve-system 4 is composed of two cylindrical bushes 9, 10 mounted coaxially one inside the other. The outer bush 9 comprises an offset determining a segment 11 of larger diameter and a segment 12 of smaller diameter. The segment 11 is mounted in liquid-tight manner into the bore of the case 1. Together with a base 14 sealing the bush bore 13, the segment 12 bounds the supply chamber 2. The inner bush 10 also comprises an offset and rests in rotatable and liquid-tight manner by its cylindrical outer surfaces against the wall surfaces of the bush bore 13. The contact area between the bushes 9 and 10, and hence their rotational drag, at the bush 10 is lowered by the offset of the bush bore 13 and of the outer surface of the bush 10. The end of the reservoir 3 facing the bush 10 is sealed by a base 15. The bore of the bush 10 forms a sealed cell 16.

Both bushes 9, 10 have valve apertures 17, 18, 19, 20 radially passing through the bush walls. The valve apertures 17, 19 are present in the outer bush 9 and are located in a common axial plane. The valve apertures 18, 20 are formed in the inner bush 10 and are arrayed in two mutually perpendicular planes. The valve apertures 17 are axially positioned and associated with the valve apertures 18 and the valve apertures 19 with the valve apertures 20. When rotating the bush 10, the mutually associated valve apertures 17, 18 or 19, 20 may be made to overlap. The valve apertures 17, 18 are circular. The valve apertures 19, 20 are rectangular. The valve apertures 19 run as far as the end of the bush 9 and as a result communicate with the reservoir 3.

The base 15 of the bush 10 is connected by a shaft 21 to a rotary knob 22 which seals the rear end 23 of the case 1. By means of a cylindrical adapter 24, the rotary knob 22 rests in the bore 25 of the case 1 and it is sealed by a sealing ring 26. The rotary knob 22 is held in place axially by bosses 27 engaging an annular groove 28 in the surface of the adapter 24.

In the embodiment of FIG. 1, the bush 10 is in an angular position wherein the valve apertures 19, 20 are aligned. As a result the cell 16 communicates with the reservoir 3. Because the valve apertures 17 and 18 are 90° apart, they are substantially isolated from each other. The valve apertures 17 are sealed off by the wall of the bush 10 and the valve apertures 18 by the wall of the bush 9. Accordingly the cell 16 is isolated from the supply chamber 2. This position of the valve-system bush 10 is used to replenish ink from the reservoir 3 into the cell 16. Air present in the cell 16 is thereby displaced into the reservoir 3. This replenishing procedure is easy because of the diametrical arrangement of every set of two valve apertures 19, 20. The cell 16 being isolated in this position from the supply chamber 2, the pressure prevailing in the reservoir 3 during replenishing cannot disturb the capillary equilibrium in the supply chamber 2 and hence cannot result in undesired ink issuance at the writing tip. Moreover, because the cell 16 is isolated from the supply chamber 2, the effective volume of the supply chamber 2 is substantially lowered, whereby changes in volume of air present in the supply chamber 2 caused by fluctuations in temperature or air pressure remain small. Even in the case of extreme fluctuations, the balancing ability of the ink controller remains substantially unimpaired. Therefore the replenishing position of the valve-system bush 10 also may serve as a safety position wherein ink leakage due to ambient conditions is effectively averted.

To start writing, the bush 10 is rotated by 90° using the rotary knob 22. In this procedure, first the valve apertures 20 are moved so far away from the valve apertures 19 as to be no longer overlapping and therefore the cell 16 is now isolated from the reservoir 3. The valve apertures 17 and 18 begin to overlap only thereafter and will be aligned in their final positions and thus will connect the cell 16 with the supply chamber 2. Accordingly the isolation between the reservoir 3 and the supply chamber 2 is preserved during the entire procedure. By connecting the cell 16 to the supply chamber 2, the volume of this supply chamber 2 is enlarged to the normal size and as a result the fountain pen now can be used for writing in typical manner and the flow of ink to the writing tip is optimally controlled. Once the volume of ink in the cell 16 and in the supply chamber 2 has been used up, the cell 16 can be refilled with ink from the reservoir 3 by rotating the bush 10 back into the position shown in FIG. 1. The isolation assured by the valve-system of the invention between the reservoir 3 and the supply chamber 2 allows making the volume of the reservoir 3 unconventionally large, for instance it may be about ten-fold that of a conventional ink cartridge.

When the ink in the reservoir also has been used up, and where a writing implement with a long-life writing tip is involved, then this reservoir may be designed to be refillable in a number of ways. For instance and in the manner shown in FIG. 1, a replenishing aperture 57 with an automatically closing valve element 58 may be present in the side of the rotary knob 22, where the valve element 58 can be pierced from the outside by an injection needle of a replenishing vessel through a radial hole 29 in the case 1. The embodiments discussed below describe further designs of a replenishable reservoir.

Figure 2:
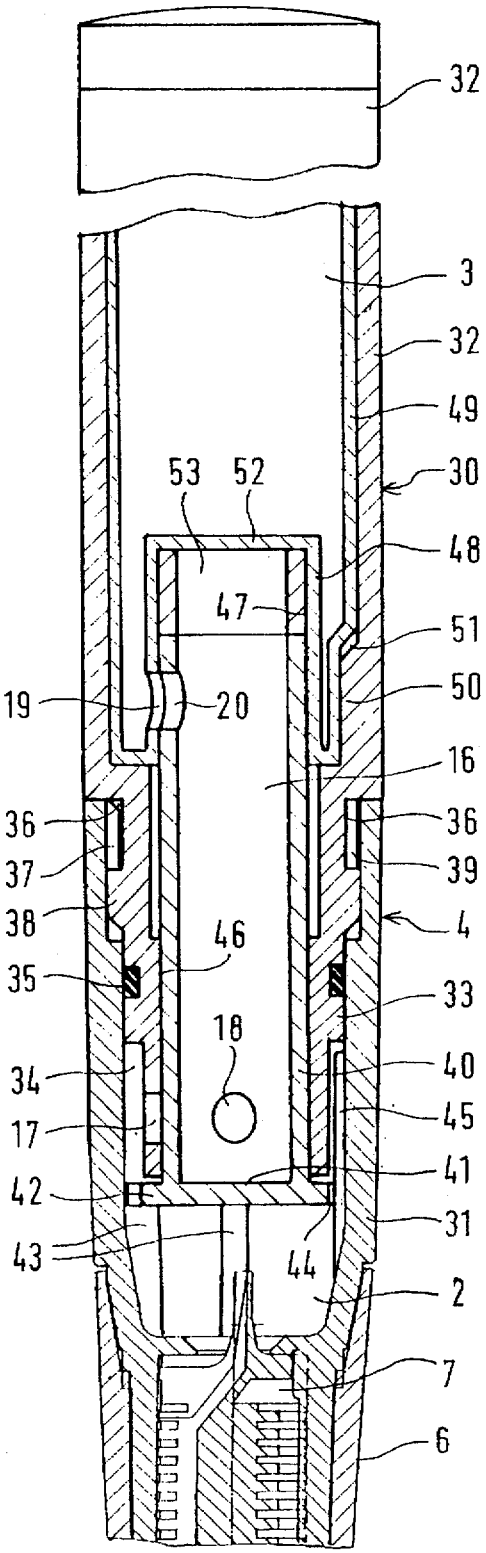
FIG. 2 is a longitudinal section of a fountain pen with divided case and a reservoir in the form of an ink cartridge.

As regards the fountain pen shown in FIG. 2, the case 30 is composed of a front segment 31 containing the supply chamber 2, the writing tip 6 and the ink controller 7, and a rear segment 32 receiving the valve-system 4 and the reservoir 3. The rear segment 32 rests in rotatable manner by its bush-shaped front end 33 of reduced diameter in the bore 34 of the front segment 31 and is sealed by a sealing ring 35 from the front segment 31. For axial affixation relative to the front segment 31, the rear segment 32 is fitted with an annular groove 36 which is engaged by bosses 37 in the form of longitudinal ribs, the bosses 37 being present in the bore 34. The bosses 37 are shaped in such a way that, when the front and rear segments 31 and 32 are being mutually engaged, they will slip over a bead 38 bounding the annular groove 36 and enter the groove. A stop rib 39 parallel to the bosses 37 is present in the annular groove 36 and limits an appropriate angle of rotation by which the rear segment 32 may be rotated relative to the front segment 31.

In this embodiment the valve-system 4 comprises a cylindrical bush 40 enclosing the cell 16 with valve apertures 18 and 20 which are mutually offset by 90°. The end of the bush 40 facing the supply chamber 2 is sealed by a base 41. The outer rim of the base 41 forms a collar 42 projecting beyond the outside surface of the bush 40 and axially resting on ribs 43 present in the supply chamber 2. The collar 42 is fitted with several recesses 44. A rib 45 of substantial length enters one of the recesses 44 and the bush 40 thereby rests irrotationally on the front segment 31. By means of its outside surface, the bush 40 is supported in rotatable and liquid-tight manner in the bore 46 of the front portion 33 of the rear segment 32. The front end of the portion 33 has a reduced diameter and includes a valve aperture 17 cooperating with the valve aperture 18.

The end of the bush 40 opposite the base 41 engages the cylindrical bore 47 of a cap 48 present at the connecting end of an ink cartridge 49 inserted into the rear segment 32 and forming the reservoir 3. The bush 40 is rotatable relative to the cap 48 and rests in liquid-tight manner against the wall of the bore 47. Its valve aperture 20 cooperates with a valve aperture 19 in the wall of the cap 48. The valve aperture 19 is located in the same axial plane as the valve aperture 17 and issues directly into the reservoir 3. The ink cartridge 49 is screw-affixed in and at the rear end of the rear segment 32. Its angular position relative to the rear segment 32 is assured by a projection 50 entering a recess 51 in the wall of the ink cartridge 49. The ink cartridge 49 also may be affixed by a bayonet lock rather than a screw lock in the rear segment 32. In the case of a bayonet lock, the projection 50 and the recess 51 may be eliminated. A free space to receive an annular lock 53 is present between the base 52 of the cap 48 and the bush 40 to lock the valve aperture 19 of the ink cartridge 49 prior to insertion. When the ink cartridge is being inserted, the lock 53 is displaced by the bush 40 into the position shown in the drawing.

In FIG. 2, the valve-system again is shown in the position for which the mutually aligned valve apertures 19, 20 connect the reservoir 3 with the cell 16 formed by the bush 40. Because of the simultaneously closed valve apertures 17, 18, the supply chamber 2 is isolated from the cell 16. When the front and rear segments 31 and 32 are rotated relative to each other by about 90°, the valve apertures 17 and 18 will overlap whereas the valve apertures 19 and 20 are distanced from each other and hence will be closed. Thereby the cell 16 is made to communicate with the supply chamber 2 to feed the writing tip 6. The particular appropriate angular position is determined by the stop rib 39 cooperating with the bosses 37. Explanatory markings may additionally be present on the outsides of the front and rear segments 31 and 32.

Figure 3:
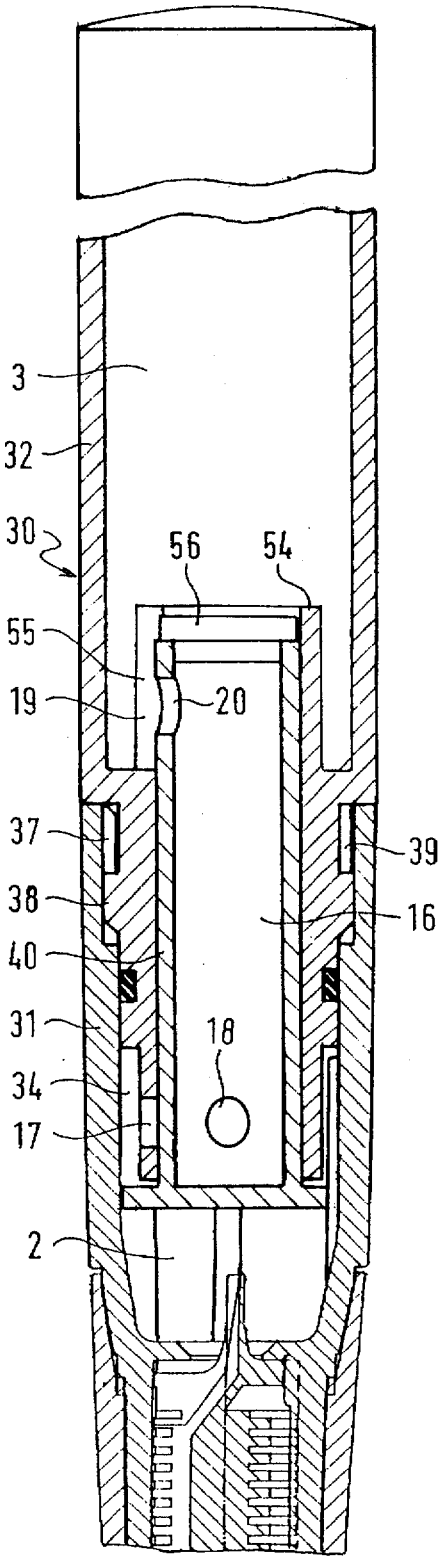
FIG. 3 is a longitudinal section of a fountain pen with divided case and with a case segment in the form of an ink cartridge.

FIG. 3 shows a variation of the fountain pen of FIG. 2, wherein the reservoir 3 is formed not by a separate ink cartridge but directly by the rear segment 32. For that purpose the rear segment 32 includes a cylindrical collar 54 entering the reservoir 3 and tightly enclosing the end of the bush 40 which faces the reservoir 3. The collar 54 is fitted with a slot 55 forming the valve aperture 19. The open end of bush 40 is tightly sealed by a stopper 56. In this design the rear segment 32 may be provided with an externally accessible replenishing aperture through which the reservoir 3 may be refilled with ink. Together with the valve-system, the rear segment 32 is separable from the front segment 31 and it assumes the function of a renewable ink cartridge of large volume. For that purpose the stop rib 39 is designed in such manner that at increased rotational torque, it can be passed over by a boss 37, whereby then the rear segment 32 will be rotatable relative to the front segment 31 into a position outside the normal setting range when actuating the valve-system, and wherein preferably all valve apertures 17 through 20 are closed. In this position the bosses 37 are opposite recesses in the bead 38, thereby allowing axial removal of the rear segment 32 together with the bush 40 mounted therein from the bore 34 of the front segment 31. Reversely, a new ink-filled rear segment 32 may then be appropriately inserted into the front segment 31 and moved by rotation into the called-for operational position. The valve-system being closed for the exchange position, no special locking of the reservoir 3 in the rear segment 32 is needed.

Figure 4:
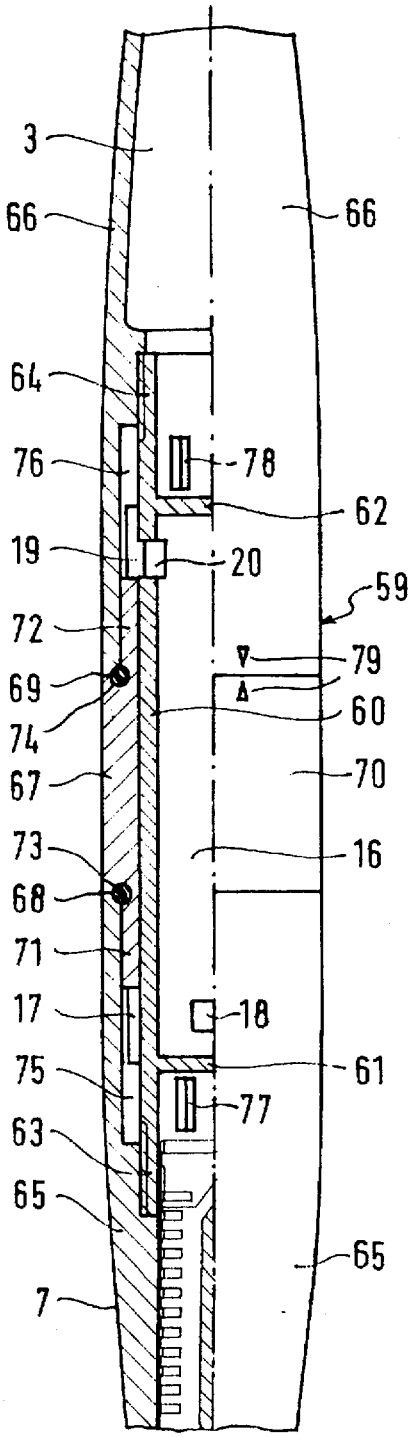
FIG. 4 is a longitudinal section of a fountain pen of which the inner valve-system bush is integrated into the case.

As regards the fountain pen shown in FIG. 4, the inside bush 60 of the valve-system is integrated into the case 59. The bush 60 is closed at both ends by bases 61 and 62 and is fitted with externally threaded fittings 63, 64 each axially projecting beyond the respective base 61, 62. The front fitting 63 is threaded into a front case bush 65 containing a writing tip with an ink controller 7. A gap forming the supply chamber 2 is present between the ink controller 7 and the base 61. The rear fitting 64 is threaded into a rear case bush 66 containing the reservoir 3.

A bush 67 is mounted in rotatable and liquid-tight manner on the cylindrical outer surface of the bush 60 and comprises a central zone of larger wall thickness bounded by two steps 68 and 69 and two end zones 71 and 72 of lesser wall thickness. The tubular-case zones 65 and 66 cover the end zones 71 and 72 outwardly and by their mutually facing end surfaces form an axial guide for the steps 68, 69 of the central zone 70. The steps 68, 69 each are provided with a groove housing a sealing ring 73 and 74.

As in the above described embodiments, the bush 60 is fitted with valve apertures 18, 20 cooperating with slot-formed valve apertures 17, 19 in the bush 67. The valve apertures 17, 19 communicate with annular chambers 75, 76 formed by the fittings 63, 64 and the case bushes 65, 66. The annular chamber 75 communicates through apertures 77 in the fitting 63 with the supply chamber 2 and the annular chamber 76 communicates through apertures 78 in the fitting 64 with the reservoir 3.

As regards the fountain pen shown in FIG. 4, the valve-system is operated by seizing the bush 67 at is center zone 70 and by rotating it relative to the inner bush 60 rigidly joined to the tubular-casing bushes 65, 66. In this manner, the effects and switch settings already described above can be achieved. Markings 79 on the outside of the tubular-casing bushes 65, 66 and on the zone 70 of the bush 67 indicate the particular desired switch position.

Figure 5:
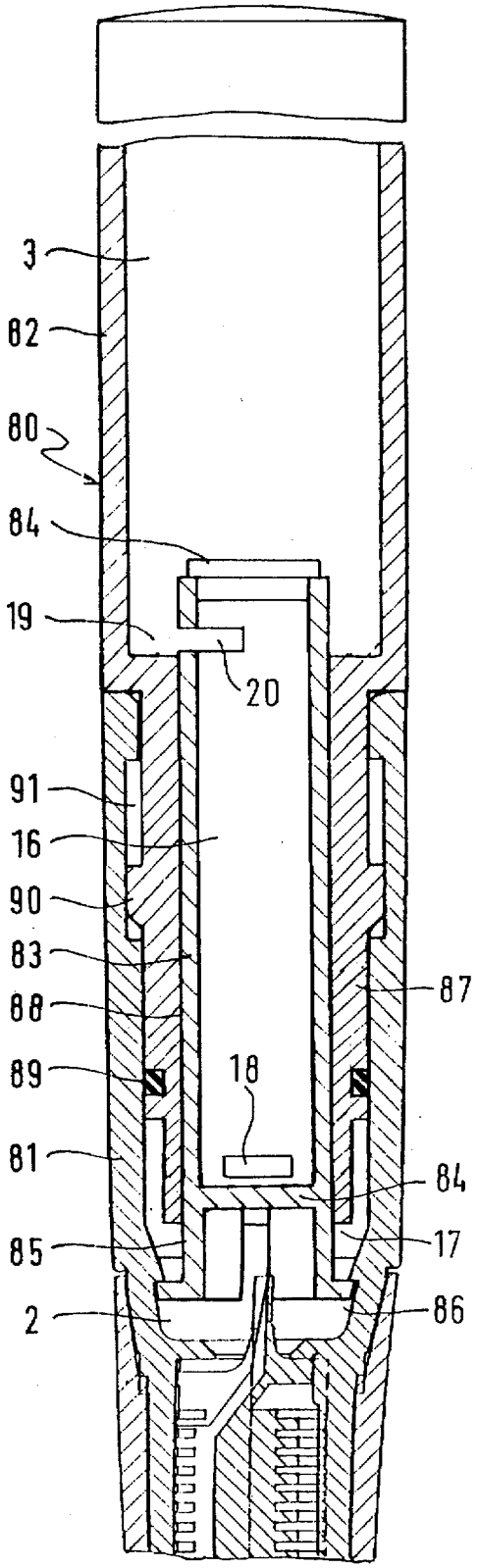
FIG. 5 is a longitudinal section of a fountain pen with divided case of which the case segments are mutually axially displaceable to drive the valve-system.

The fountain pen shown in FIG. 5 comprises a two-segment tubular casing 80, namely being composed of a front segment 81 and a rear segment 82, the front segment 81 containing the supply chamber 2 and the rear segment 82 containing the reservoir 3. The valve-system comprises an inner bush 83 forming the cell 16 and sealed at both its ends by a base 84. Rectangular valve apertures 18, 20 are present in the wall of the bush 83. At its end side facing the supply chamber 2, the bush 83 is fitted with several hooks 85 entering an annular groove 86 in the wall of the front segment 81 and thereby rigidly affixing the bush 83 to the front segment 81. The valve-system outer bush 87 is constituted by the tapered, front end of the rear segment 82. The bush 87 can be fully inserted into the bore 88 of the front segment 81 and is sealed by a sealing ring 89 from the front segment 81. The bush 87 has a raised annular bead 90 on its outside surface, with the bead entering an annular groove 91 in the bore 88. Axially the annular groove 91 is larger than the annular bead 90 and thereby allows limited axial displacement of the rear segment 82 together with the bush 87 relative to the front segment 81. The axial displaceability exceeds the sum of the axial length of the valve apertures 18, 20. No special valve apertures are present in the bush 87. Instead, the valve apertures 17, 19 cooperating with the valve apertures 18, 20 are constituted by the free annular gaps on both sides of the end sides of the bush 87.

The drawing shows the fountain pen in a position wherein the bush 87 has been fully inserted into the front segment 81 and wherein the rear segment 82 rests against the front segment 81. In this position the valve aperture 18 is covered by the bush 87 and hence sealed by it. The valve aperture 20 is outside the bush 87 and through the annular gap 19 communicates with the reservoir 3. In order to switch the valve-system, the front and rear segments are pulled apart until the annular collar 90 rests against the other sidewall of the annular groove 91. In the process the bush 87 first passes over the valve aperture 20 which thereby becomes sealed. Next the valve aperture 18 is cleared by the bush 87 and thereby the cell 16 is made to communicate with the supply chamber 2. In order to keep the two segments 81, 82 in the two described switching positions, indexing means or the like may be provided which require being surmounted to reach the particular switching position.

Besides the above described illustrative embodiments, the deposition implement of the invention also may be reduced to practice in other advantageous ways. For instance, the valve bushes may be composed of several bush elements. Again the cell 16 may be constituted by the outer valve bush, whereas the inner valve bush comprises two mutually separate bush elements in the zone of the valve apertures.

I claim:

1. A liquid-depositing implement comprising: a tubular case containing a supply chamber and a reservoir isolated from said supply chamber, both said supply chamber and said reservoir being fillable with a deposition liquid; a deposition element mounted on said case and connected to said supply chamber; said supply chamber including a cell with a valve-system interrupting communication between said cell and said reservoir when said cell communicates with said deposition element, and interrupting communication between said cell and said deposition element when said cell communicates with said reservoir; said valve-system including two mutually telescoping and tightly adjoining bushes enclosing a cavity forming said cell, said cavity having at each of its axial ends at least one base affixed to one of said inner or outer bush, and two sets of cooperating valve apertures present in walls of said bushes and/or said bases wherein by moving one bush relative to the other bush, one of said sets of valve apertures will pass from a communicating position having said valve apertures of both bushes overlap into a closed position having said wall of one bush seal said valve aperture in the other bush and the other set of valve apertures passes from said closed position into said communicating position, all of said valve apertures being sealed in a valve-system position which is intermediate to said two communicating positions.

2. Liquid-depositing implement defined in claim 1, wherein said case comprises two mutually rotatable segments, and a means for transmitting rotary motion; one segment being linked to one of said bushes and the other segment being linked to the other of said bushes by said means for transmitting rotary motion.

3. Liquid-depositing implement defined in claim 2, wherein one of said valve-system bushes is of said case segments.

4. Liquid-depositing implement defined in claim 1, wherein said case comprises a rear segment and a front segment which are linked together in a rotatable manner, said rear segment containing said reservoir and said front segment containing said supply chamber and deposition element, each of said segments being rigidly joined to one bush of said valve-system.

5. Liquid-depositing implement defined in claim 1, wherein said reservoir comprises an exchangeable, large-volume writing-liquid cartridge.

6. Liquid-depositing implement defined in claim 5, wherein said cartridge is fitted with a cylindrical connection defining a zone of said outer valve bush and including said valve apertures through which said cartridge can communicate with said cell.

7. Liquid-depositing implement defined in claim 6, wherein said case and said cartridge include mutually matching stops whereby said cartridge can be affixed in a specified installed position in said case segment.

8. Liquid-depositing implement defined in claim 4, wherein said rear case segment containing said reservoir is detachable from said front case segment and is an exchangeable cartridge.

9. Liquid-depositing implement defined in claim 4, wherein said inner bush is connected to said front case segment and is sealed at both ends by a base and wherein said outer bush is open at both ends and is integrated into said rear case segment.

10. Liquid-depositing implement defined in claim 1, wherein said inner bush is rigidly joined at one end to a front case segment and at the other end to a rear case segment and said outer bush comprises an externally accessible gripping surface extending between said two case segments whereby said outer bush can be moved relative to said inner bush.

11. Liquid-depositing implement defined in claim 1, wherein said reservoir includes a sealable replenishing aperture accessible only from the outside of said implement when said cell is closed relative to said supply chamber and open relative to said reservoir.

12. Liquid-depositing implement defined in claim 1, wherein said valve apertures connecting said cell to said depositing element are control paths to control the flow of said deposition liquid to said depositing element.

13. Liquid-depositing implement defined in claim 12, wherein a flow cross-section of at least one of said control paths is adjustable by reference to markings on said case.

14. Liquid-depositing implement defined in claim 1, wherein available switch positions of said valve-system are determined by stops.

15. Liquid-depositing implement defined in claim 1, wherein said case comprises two axially displaceable segments, and means for transmitting longitudinal motion; one segment being linked to one of said bushes and the other segment being linked to the other of said bushes by said means for transmitting longitudinal motion.

16. Liquid-depositing implement defined in claim 15, wherein one of said valve-system bushes is constituted by one of said case segments.

17. Liquid-depositing implement defined in claim 1, wherein said case comprises a rear segment and a front segment linked together in a longitudinally displaceable manner, said rear segment containing said reservoir and said front segment containing said supply chamber and said deposition element, each of said segments being rigidly joined to one bush of said valve-system.

18. Liquid-depositing implement defined in claim 17, wherein said rear case segment containing said reservoir is detachable from said front case segment and is an exchangeable cartridge.

19. Liquid-depositing implement defined in claim 17, wherein said inner bush is connected to said front case segment and is sealed at both ends by a base and wherein said outer bush is open at both ends and is integrated into said rear case segment.

20. Liquid-depositing implement defined in claim 1, wherein available switch positions of said valve-system are denoted by markings on said case.

* * * * *